US010982433B2

(12) United States Patent
Buck et al.

(10) Patent No.: US 10,982,433 B2
(45) Date of Patent: Apr. 20, 2021

(54) MONOLITHIC ACOUSTICAL SYSTEM

(71) Applicant: USG Interiors, LLC, Chicago, IL (US)

(72) Inventors: Curtis F. Buck, Grayslake, IL (US); Michael A. Delgado, Chicago, IL (US); William R. Munoz, Frankfort, IL (US); Andrew L. Schmidt, Evanston, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 16/440,014

(22) Filed: Jun. 13, 2019

(65) Prior Publication Data

US 2020/0002938 A1 Jan. 2, 2020

Related U.S. Application Data

(60) Provisional application No. 62/691,042, filed on Jun. 28, 2018.

(51) Int. Cl.

| | |
|---|---|
| ***E04B 1/84*** | (2006.01) |
| ***E04C 2/04*** | (2006.01) |
| *E04B 1/82* | (2006.01) |

(52) U.S. Cl.

CPC ..... *E04B 1/8409* (2013.01); *E04C 2/043* (2013.01); *E04B 2001/8263* (2013.01); *E04B 2001/8495* (2013.01)

(58) Field of Classification Search

CPC ..... E04B 1/8409
USPC ..... 52/410, 787.11
See application file for complete search history.

(56) References Cited

U.S. PATENT DOCUMENTS

| | | | | | |
|---|---|---|---|---|---|
| 1,612,734 | A | * | 12/1926 | Knight | E04B 1/62 52/236.6 |
| 1,649,481 | A | * | 11/1927 | McWane | E04B 1/62 52/410 |
| 1,721,461 | A | * | 7/1929 | Mazer | E04B 1/8409 181/290 |
| 1,974,951 | A | * | 9/1934 | Doorentz | E04B 1/8409 52/791.1 |
| 2,280,631 | A | * | 4/1942 | Coffey | A01B 15/02 181/293 |
| 2,324,706 | A | * | 7/1943 | Jacobson | E04B 1/8404 181/285 |
| 2,540,349 | A | * | 2/1951 | Reed | B28B 19/003 52/410 |
| 3,312,304 | A | * | 4/1967 | Philipp | E04B 9/0485 181/290 |
| 3,525,189 | A | | 8/1970 | Nelsson | |
| 4,084,367 | A | * | 4/1978 | Saylor | B29D 24/005 428/113 |

(Continued)

FOREIGN PATENT DOCUMENTS

DE 8705270 U1 7/1987

OTHER PUBLICATIONS

Written Opinion of the International Searching Authority and International Search Report dated Oct. 8, 2019 for International PCT Application No. PCT/US2019/038617, filed Jun. 22, 2019.

*Primary Examiner* — Patrick J Maestri
*Assistant Examiner* — Joseph J. Sadlon
(74) *Attorney, Agent, or Firm* — Pearne & Gordon LLP

(57) ABSTRACT

A composite structure for improving the acoustical properties of a low NRC membrane including a sound absorbing layer and a porous, scrim covered, perforated drywall layer.

6 Claims, 2 Drawing Sheets

(56) References Cited

U.S. PATENT DOCUMENTS 4,237,178 A * 12/1980 Mazaki ..... B32B 15/14 442/228
4,286,420 A * 9/1981 Pharmakidis ..... E04B 1/74 52/404.1
4,624,089 A * 11/1986 Dunker ..... E04C 2/06 52/410
4,869,038 A * 9/1989 Catani ..... E04B 1/4185 52/410
5,009,051 A * 4/1991 Trezza ..... E04B 1/6806 52/309.4
5,424,497 A * 6/1995 Dias ..... E04B 1/86 181/286
6,092,344 A * 7/2000 Kelly ..... B32B 3/28 52/410
6,675,551 B1 * 1/2004 Fuchs ..... E04B 1/86 52/144
6,725,616 B1 * 4/2004 Pease ..... E04B 1/762 52/309.12
6,772,859 B2 * 8/2004 D'Antonio ..... E04B 1/84 181/293
6,901,713 B2 * 6/2005 Axsom ..... E04B 1/80 52/309.17
7,325,366 B1 * 2/2008 Hohmann, Jr. ..... E04B 1/4178 52/167.1
7,503,428 B1 * 3/2009 Johnson ..... E01F 8/007 181/290
7,661,511 B2 * 2/2010 Hasegawa ..... E04B 9/045 181/293
8,555,583 B2 * 10/2013 Ciuperca ..... B23P 11/00 52/309.12
8,684,134 B2 4/2014 Dugan et al.
8,770,345 B2 7/2014 Dugan et al.
8,925,677 B2 1/2015 Dugan et al.
8,959,861 B1 * 2/2015 Wambaugh ..... B32B 3/02 52/409
9,163,397 B2 * 10/2015 Willson ..... B32B 5/18
9,738,796 B1 8/2017 Bury et al.
10,316,201 B2 * 6/2019 Hulka ..... E04B 9/001
2008/0083184 A1 * 4/2008 Smith ..... E04D 3/351 52/410

* cited by examiner

MONOLITHIC ACOUSTICAL SYSTEM

This application claims the benefit of U.S. provisional patent application Ser. No. 62/691,042, filed Jun. 28, 2018.

BACKGROUND OF THE INVENTION

The invention is directed to a sound absorbing or acoustical composite structure that can be used for ceilings, including sloped ceilings, and walls in the interior of occupied buildings.

PRIOR ART

U.S. Pat. Nos. 8,684,134, 8,770,345 and 8,925,677 disclose systems for constructing an acoustical membrane, typically a suspended ceiling, that appears monolithic, relatively smooth, and imperforate. It is known to provide sound absorbing panels, typically porous low density mineral fiber panels on the upper side of these constructions to improve their sound absorption properties.

SUMMARY OF THE INVENTION

The inventive composite structure comprises outward perforated drywall panels attached to or fixed to inward sound insulation layers or sound absorbing boards. For example, the perforated drywall panels and the rigid sound absorbing panels can be attached together and to an acoustical hard faced substrate such as a drywall ceiling or wall by parallel spaced Z-shaped furring strips. The perforated drywall panels after installation are taped at their edge joints and then painted with a continuous acoustically transparent coating to conceal the perforations and joints and thereby obtain the look of a relatively smooth monolithic ceiling or wall, but with high acoustical properties.

It has been discovered that the disclosed composite structure when abutting or in close adjacency to an acoustically hard surface or substrate and, therefore, without a typical plenum (i.e. a space with a depth often of 16 inches or more existing immediately behind the composite structure) produces high NRC (Noise Reduction Coefficient) values ranging from about 0.8 to about 0.9.

The composite structure has the surprising nature that it achieves NRC values that are relatively high and that are not significantly affected by the presence or absence of an open space or plenum behind the composite structure. In some cases, contrary to ordinary experience, the inventive composite structure can exhibit higher NRC performance where no plenum space exists as compared to performance with a plenum.

The high noise absorption and thin cross-section (nominally 1⅝ inches) of one version of the composite structure of the invention makes the structure especially useful in original and retrofit ceiling applications where no or limited plenum space is available. Since the inventive composite structure can be used directly against an existing acoustically hard surface, the composite structure can be used in retrofit applications where a drywall or like surface is covered to obtain desired acoustical performance. In the latter case, the retrofitted space is not unduly reduced in size nor are pre-existing walls greatly thickened. The composite structure can be used in original construction directly on studs or joists, for example.

DESCRIPTION OF THE PREFERRED EMBODIMENT

Figure 1:
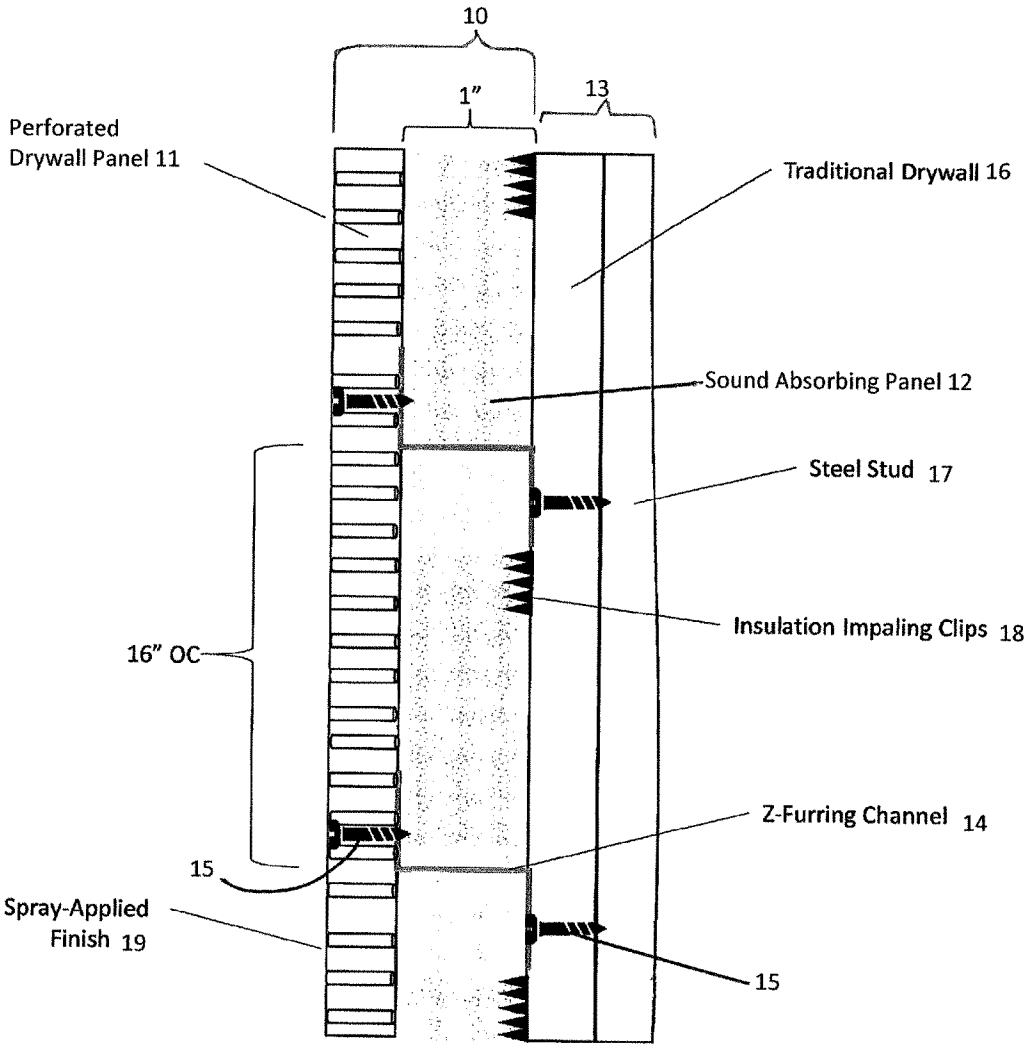
FIG. 1 is a diagrammatic cross-sectional view of a composite structure of the invention attached to a drywall and stud wall.

The composite structure 10 of the invention is comprised of perforated drywall sheets 11 and sound absorbing or sound insulation media, preferably in the form of rigid panels 12. In the illustration of FIG. 1, the perforated drywall sheets 11 and sound absorbing panels or sheets 12 are mechanically secured together and to an acoustical hard surface in the form of a drywall wall 13, for example, with conventional sheet metal Z-shaped furring strips or channels 14 and mechanical fasteners in the form of self-drilling screws 15. Alternatively, the panels or sheets 11, 12 can be adhesively secured together and to the wall or other substrate. The term "secured" is used in the same sense as "fixed" and is to be distinguished, for example, from simple contact developed by loose confinement.

Referencing FIG. 1, the drywall wall 13 comprises conventional or traditional gypsum-based drywall sheets 16 fixed to vertical studs 17, shown schematically, and which can be, for example, roll formed sheet metal or wood.

Suitable perforated drywall sheets 11 of the composite structure 10 are disclosed in U.S. Pat. Nos. 8,684,134, 8,770,345, and 8,925,677, the disclosures of which are incorporated herein by reference. A suitable perforated drywall sheet 11 is nominally ⅝ inch thick and nominally 4 foot by 8 foot in planar dimension or an industry metric equivalent of these dimensions. The perforated drywall sheets 11 have a gypsum core faced with paper on both sides like conventional drywall and are through-perforated, for example, with ⅜ inch holes representing from 13.2% to 28.4% and preferably about 17.2% or about ⅙ of the sheet surface area, for example. The front or outer side of the perforated drywall panel or sheet has an adhesive attached ceiling panel acoustical facing scrim or veil 20 such as the product marketed by Owens Corning under the product name A125 EX-CH52. The back of the panel or sheet 11 can be covered with an adhesively attached acoustical scrim or veil layer 21 such as the product named VL P88-KP01 marketed by Owens Corning. Both of the scrims are non-perforated and non-woven glass fiber-based layers that are acoustically transparent being characterized by suitable air porosity. The adhesive materials and application techniques used to attach the scrims to the perforated drywall sheet are acoustically non-blocking.

The sound absorbing panels 12 can be a wet felted or wet laid porous product of primarily mineral fiber and a suitable binder such as starch and/or latex as is known in the art. A suitable density for the panels 12 ranges between about 3.5 $lbs/ft^3$ to about 14 $lbs/ft^3$ and preferably is about 12.5 lbs. per cubic foot. The panels 12 can be nominally 1 inch or 2 inch thick and 15.5×48 inches in planar dimensions. The panels 12 are preferably rigid such that they do not immediately sag more than ⅜ inch on a 48 inch span. A typical panel 12 of 1 inch thickness (14 $lb/ft^3$) alone will exhibit an NRC of about 0.90 and of 2 inch thickness, (3.5 $lb/ft^3$) alone will exhibit an NRC of about 1.05.

The composite structure 10 formed by the sound absorbing panels 12 and perforated drywall sheets 11 can be mounted directly, i.e. without an appreciable space, to an acoustically hard surface such as that produced by conventional drywall 16 of the wall 13 with sheet metal Z-style furring strips 14 of a stand-off dimension corresponding to the nominal thickness of the sound absorbing panels 12. The furring strips 14 should have relatively narrow faces to minimize obstruction of the face area of the panels 11, 12.

The furring strips 14 are mechanically fixed to the wall 13 with self-drilling screw fasteners 15, preferably being set into the horizontally spaced studs 17, and serving to fix the sound absorbing panels 12 in place on the acoustically hard surface substrate or wall 13. The furring strips 14 typically are parallel on 16 inch centers and perpendicular to the studs 17, for example. Impaling clips 18 having a rectangular U-shaped cross-section with opposed legs forming teeth or barbs, can be fixed to the wall 13 before placement of the sound absorbing panels 12 to initially hold the panels in place. The perforated drywall panels or sheets 11 are mechanically fixed to the furring strips 14 with self-drilling screws 15 spaced along the width (or length) of the sheets 11 so that these panels are fixed relative to the sound absorbing panels 12 and to the wall 13. The somewhat compressible nature of the sound absorbing panel 12 allows the panel to fully contact or nearly fully contact the adjacent sheets 11, 16. Any gaps between the sound absorbing panels and drywall 16 and between the sound absorbing panel and perforated drywall 11 can be negligible, i.e. less than 25% of the thickness of the perforated drywall sheets 11.

The perforated drywall panels 11 are set in place, with their edges preferably abutting in a manner essentially the same as plain or conventional drywall is hung. Joints at the abutting or closely adjoining edges of the perforated drywall panels 11 are covered with joint compound and, typically, paper joint tape. The top coat of joint compound can be specially formulated for a desired final color match with the outer scrim covered face of the perforated drywall sheet 11. Thereafter, the taped perforated drywall panels or sheets 11 are coated with a non-blocking acoustically transparent paint 19 such as disclosed in U.S. Pat. No. 9,738,796, the disclosure of which is incorporated herein by reference. This coating or finish 19 can be applied in several cross-direction passes to assure a uniform appearance. When the coating is dry it conceals any residual image of the perforations in the sheets 11 that showed through the outer typically translucent non-woven scrim 20 on the outer face of the sheets 11, the taped joint areas as well as joint compound covering screw fasteners 15 securing the sheets to the furring strips 14 or other structure. The result is a monolithic appearing or seamless wall or ceiling with superior acoustics, particularly suited for "high-end" spaces especially those requiring a large total of hard surface areas.

Figure 2:
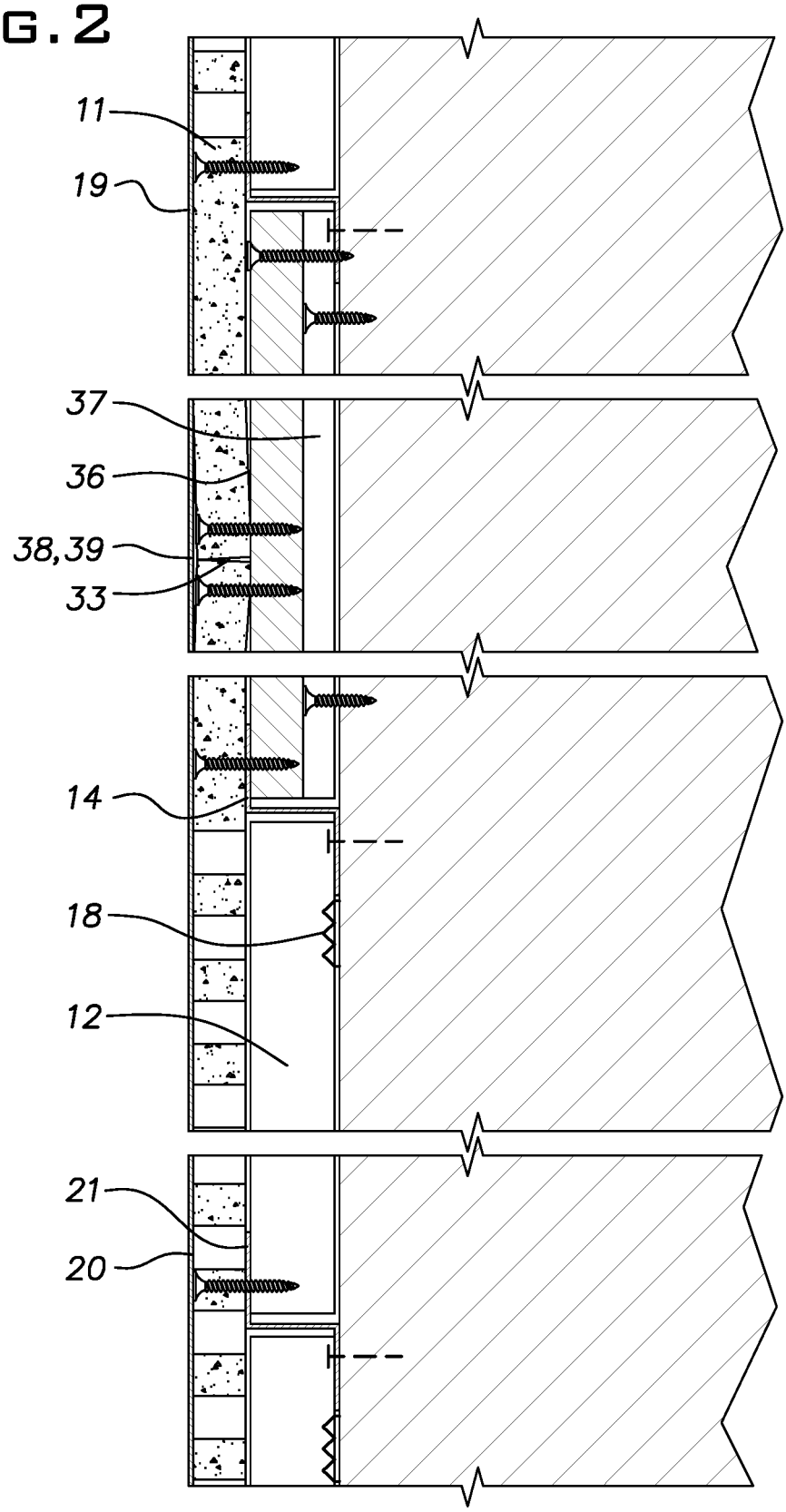
FIG. 2 is a diagrammatic cross-sectional view of the composite structure of the invention attached to a masonry wall.

FIG. 2 illustrates another application of the composite structure 10 in this case on a masonry wall 31. Elements in the structure or function that are the same or essentially the same as in FIG. 1 are designated with the same numerals. Furring Z strips 14 are fixed to the wall 31 with concrete nails or other fasteners 32. A butt joint between the perforated drywall panels 11 is illustrated at 33. Ordinary drywall is tapered on its long edges to more readily conceal tape along these edges. The short edges of conventional drywall (and the panels 11) are typically not tapered, ordinarily making joint tape concealment difficult. The outer faces of the panels 11 adjacent the butt joint 33 are tapered inwardly by drawing the associated panel ends inwardly against a board 34 which is preferably somewhat stiffer than the panels 11. An outward face 36 of the board 34 is recessed inwardly for instance about ⅛ inch from the plane of the outer faces of the sound absorbing panels or backers 12 by virtue of the combined thickness of the board 34 and a spacer panel 37. Both the spacer panel 37 and the board 34 are fixed on the wall by respective screws. The joint 33 is concealed by joint tape 38 and joint compound 39 applied across the recessed face portions of the panels 11 in a known manner.

The composite structure 10 of the acoustical coated, scrim clad, perforated drywall 11 and sound absorbing media or "backer" 12 has unique acoustical properties. Conventional acoustical panels, such as those used in suspended ceilings, typically produce improved NRC (noise reduction coefficient) ratings when provided with a plenum or space at their rear or upper sides.

Surprisingly, the composite structure 10 produces the same and sometimes better acoustical performance measured NRC, when it is mounted directly on an acoustically hard substrate. The table below refers to the sound absorbing panel or layer 12 as the "backer" and the coated, scrim clad, perforated drywall panel 11 as the "perf panel". The 1 inch mineral fiber based backer has a density of 14 lb/ft$^3$ and the 2 inch mineral fiber based backer has a density of 3.5 lb/ft$^3$.

TABLE

| NRC Performance: | | | |
|---|---|---|---|
| Backer 12 | Backer 12-Only | Perf. Panel & Backer (composite structure 10), E-400 | Perf. Panel & Backer (composite structure 10), Direct Mount |
| 1" | 0.90 | 0.80 | 0.80 |
| 2" | 1.05 | 0.85 | 0.90 |

The table column with the term "E-400" refers to an industry accepted test where a plenum height of 400 mm is simulated. The table column with the term "Direct Mount" refers to a test where the composite structure 10 is mounted directly on a hard surface.

Study of the Table shows that the composite structure 10 performs as well without a plenum (1" backer 12) or better without a plenum (2" backer 12). In all cases the composite structure 10 produces NRC values that are regarded as relatively high in the suspended ceiling industry. Notably, the composite structure 10 can afford high NRC values of at least about 0.75 and preferably at least 0.80 with a nominal thickness of 1⅝ inch thickness.

The composite structure 10 of the perforated drywall sheets 11 and sound absorbing panel or backer 12 can be installed on a membrane or substrate comprising any one of a variety of known ceiling or wall constructions, especially one with poor noise reduction properties. For example, such ceiling constructions can include drywall covered wood or metal joists, including, for example, engineered wood joists or trusses and metal bar joists, precast or cast in place concrete covered with drywall or plaster or uncovered. Wall membranes or substrates can include, for example, wood or metal studs covered with drywall, plaster or paneling. Other wall constructions can include masonry, precast, and poured in place concrete membranes.

Acoustically hard wall or ceiling surfaces such as provided by plain or conventionally painted drywall, concrete, masonry or plaster will typically exhibit an NRC of 0.10 or less and can all be benefited acoustically by being directly covered by the composite structure 10.

The acoustical composite structure 10 of the perforated drywall sheets 11 and sound absorbing panels 12 can be installed on an existing ceiling of sufficient load capacity in essentially the same way as on a wall as described herein. Variations of the above-described installation are envisioned. For example, the furring strips 14 may be omitted where the sound absorbing panels 12 are mechanically or adhesively fixed to an existing wall or ceiling or like substrate and the perforated drywall sheets 11 are thereafter fixed to the wall or ceiling with mechanical fasteners such as screws driven through the perforated drywall sheets and the sound absorbing panels. Alternatively, for instance, the sound absorbing panels may first be attached to the perforated drywall sheets and thereafter the perforated drywall sheets can be mechanically fixed to a wall, ceiling or other substrate with fastening screws or the like driven through the perforated drywall sheet and the sound absorbing panel into the substrate. In both these variations like the above-described construction, the perforated drywall sheet and the sound absorbing or insulating panel are fixed together at least when the perforated drywall sheet is mounted on an underlying carrier formed by a pre-existing wall or ceiling, or the like. The installation of the composite structure 10 is characterized by the sound absorbing panel 12 and perforated drywall sheet 11 abutting or nearly abutting and being directly fixed to a supporting structure or membrane such as an existing wall or ceiling typically exhibiting an NRC of less than 0.10 itself. In some instances, the sound absorbing layer 12 can be non-rigid and in the form of a batt, for example.

When installed directly on an acoustical hard surface, in some instances, the composite structure can achieve better acoustical absorption than when a plenum or open space exists directly behind the composite structure, a phenomena not ordinarily experienced but which confirms the inherent ability of the disclosed composite structure to reliably obtain desirably high sound absorption even when directly backed-up with an acoustically hard surface, i.e. one that, alone, exhibits an NRC of less than 0.10.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A construction comprising a rigid membrane extending across a wall or ceiling area, the membrane exhibiting an NRC of 0.10 or less when measured from the side of the membrane facing a space to be occupied, wherein an improvement comprises a combination sound absorbing covering and the covering comprising a porous, fibrous sound absorbing layer in contact with or closely adjacent the space facing membrane side, a plurality of perforated drywall sheets covering the sound absorbing layer and attached to the membrane, the perforated drywall being clad on each side with a non-woven porous scrim, adjacent edges of the sides of the drywall panels facing the space to be occupied including the respective scrim being taped and covered with joint compound, the respective scrim and joint compound being covered with an acoustically transparent coating, the combination of the membrane, sound absorbing layer, scrim clad perforated drywall sheets and coating exhibiting an NRC of at least 0.75 when measured from a side facing the space to be occupied.

2. The construction of claim 1, wherein the sound absorbing layer is attached directly to the membrane and the perforated drywall is secured to the membrane.

3. The construction of claim 2, wherein the perforated drywall is attached to parallel furring strips attached to the membrane.

4. The construction of claim 3, wherein the furring strips are mechanically attached to the membrane and the perforated drywall is screw attached to the furring strips.

5. The construction of claim 4, wherein the furring strips provide spaces for reception of the sound absorbing layer.

6. The construction of claim 5, wherein the sound absorbing layer is a rigid board attached to the membrane.

* * * * *